US006056379A

United States Patent [19]

Weng

[11] Patent Number: 6,056,379

[45] Date of Patent: May 2, 2000

[54] SLIDING TRACK ASSEMBLY

[76] Inventor: Kuo-Chan Weng, No. 196-1, Hsin Chung Li, Tu Ku Chen, Yun Lin Hsien, Taiwan

[21] Appl. No.: 09/326,536

[22] Filed: Jun. 7, 1999

[51] Int. Cl.[7] ..... A47B 88/00

[52] U.S. Cl. ..... 312/334.11; 312/334.17

[58] Field of Search ..... 312/334.7, 334.8, 312/334.9, 334.11, 334.13, 334.17, 334.32, 334.33, 334.38, 330.1

[56] References Cited

U.S. PATENT DOCUMENTS

| | | | |
|---|---|---|---|
| 2,675,277 | 4/1954 | McClellan | 312/334.11 X |
| 3,059,978 | 10/1962 | Fall | 312/334.11 X |
| 4,469,384 | 9/1984 | Fler et al. | 312/334.11 X |
| 5,472,272 | 12/1995 | Hoffman | 312/334.17 X |
| 5,551,775 | 9/1996 | Parvin | 312/334.33 X |
| 5,851,059 | 12/1998 | Cirocco | 312/334.11 |

FOREIGN PATENT DOCUMENTS

| | | | |
|---|---|---|---|
| 935266 | 8/1963 | United Kingdom | 312/334.33 |

*Primary Examiner*—Peter M. Cuomo
*Assistant Examiner*—James O. Hansen
*Attorney, Agent, or Firm*—Donald C. Casey, Esq.

[57] ABSTRACT

A sliding track assembly, which includes an outer track having two inner flanges bilaterally and longitudinally provided on the inside, an intermediate track moved in and out of the outer track, an inner track moved in and out of the intermediate track, the inner track having two outer flanges bilaterally and longitudinally provided on the outside, and a transmission mechanism provided at two opposite lateral sides of the intermediate track, the transmission mechanism including a plurality of rolling elements respectively disposed in contact between the inner flanges at the outer track and the outer flanges at the inner track to guide relative movement between the intermediate track and the inner or outer track.

1 Claim, 4 Drawing Sheets

SLIDING TRACK ASSEMBLY

BACKGROUND OF THE INVENTION

The present invention relates to a sliding track assembly for use with a drawer, and more particularly to such a sliding track assembly that can be smoothly and stably moved with the drawer without causing an impact.

FIG. 1 shows a sliding track assembly according to the prior art. This structure of sliding track assembly comprises an inner track 10, an intermediate track 20, and an outer track 30. The outer track 30 as well as the intermediate track 20 are shaped like a channel bar. The intermediate track 20 is moved in the outer track 30. The inner track 10 is moved in the intermediate track 20. FIG. 2 is a cross sectional view of the sliding track assembly shown in FIG. 1. As illustrated in FIG. 2, first ball bearing means 21 is provided in between the inner track 10 and the intermediate track 20, and second ball bearing means 31 is provided in between the intermediate track 20 and the outer track 30. The first ball bearing means 21 holds symmetrical pairs of balls 22 bilaterally and revolvably maintained in contact between the outside wall of the inner track 10 and the inside wall of the intermediate track 20. The second ball bearing means 31 holds symmetrical pairs of balls 32 bilaterally and revolvably maintained in contact between the outside wall of the intermediate track 20 and the inside wall of the outer track 30. When in use, the outer track 30 is fixedly fastened to the cabinet (or desk), the inner track 10 is fixedly fastened to the drawer at one side. When pulling the drawer outwards, the track assembly may be operated in one of the following two manners.

1. The inner track 10 is moved with the drawer out of the intermediate track 20, then the intermediate track 20 is carried out of the outer track 30 by the inner track 10, and then the intermediate track 20 is forced to strike stop means at an outer to end of the outer track 30 and stopped from forward movement by the stop means.

2. The inner track 10 and the intermediate track 20 are simultaneously extended out of the outer track 30, then the intermediate track 20 is stopped from forward movement when striking stop means at the outer end of the outer track 30, and then the inner track 10 is moved with the drawer out of the intermediate track 20, and then the inner track 10 is stopped from forward movement when striking stop means at the outer end of the intermediate track 20.

Because the intermediate track 20 is forced to strike stop means at the outer end of the outer track 30 and the inner track 10 is forced to strike stop means at the outer end of the intermediate track 20 when pull out the drawer, noises are produced during movement of the sliding track assembly, and the drawer tends to be forced to vibrate and noises during its inward or outward movement.

SUMMARY OF THE INVENTION

The present invention has been accomplished to provide a sliding track assembly which eliminates the aforesaid drawbacks. According to the present invention, a transmission mechanism is provided at two opposite lateral sides of the intermediate track. the transmission mechanism is comprised of a plurality of rolling elements, for example, rolling balls or needle rollers respectively disposed in contact between two outer flanges at two opposite sides of the inner track and two inner flanges at two opposite sides of the outer track.

DETAILED DESCRIPTION OF THE PREFERRED EMBODIMENT

Figure 2:
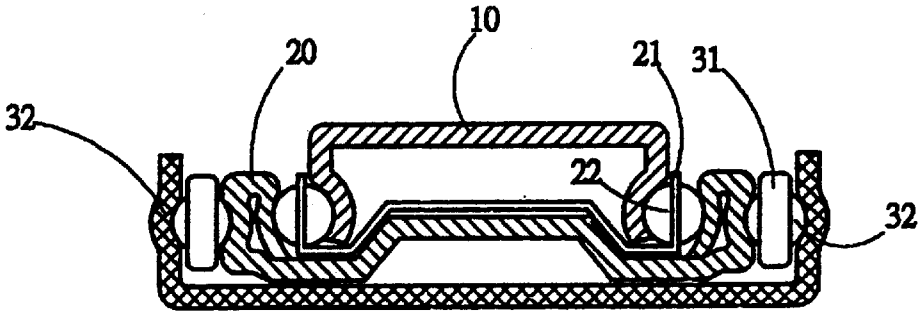
FIG. 2 PRIOR ART
FIG. 2 is a cross sectional view in an enlarged scale of the sliding track assembly shown in FIG. 1.
Figure 1:
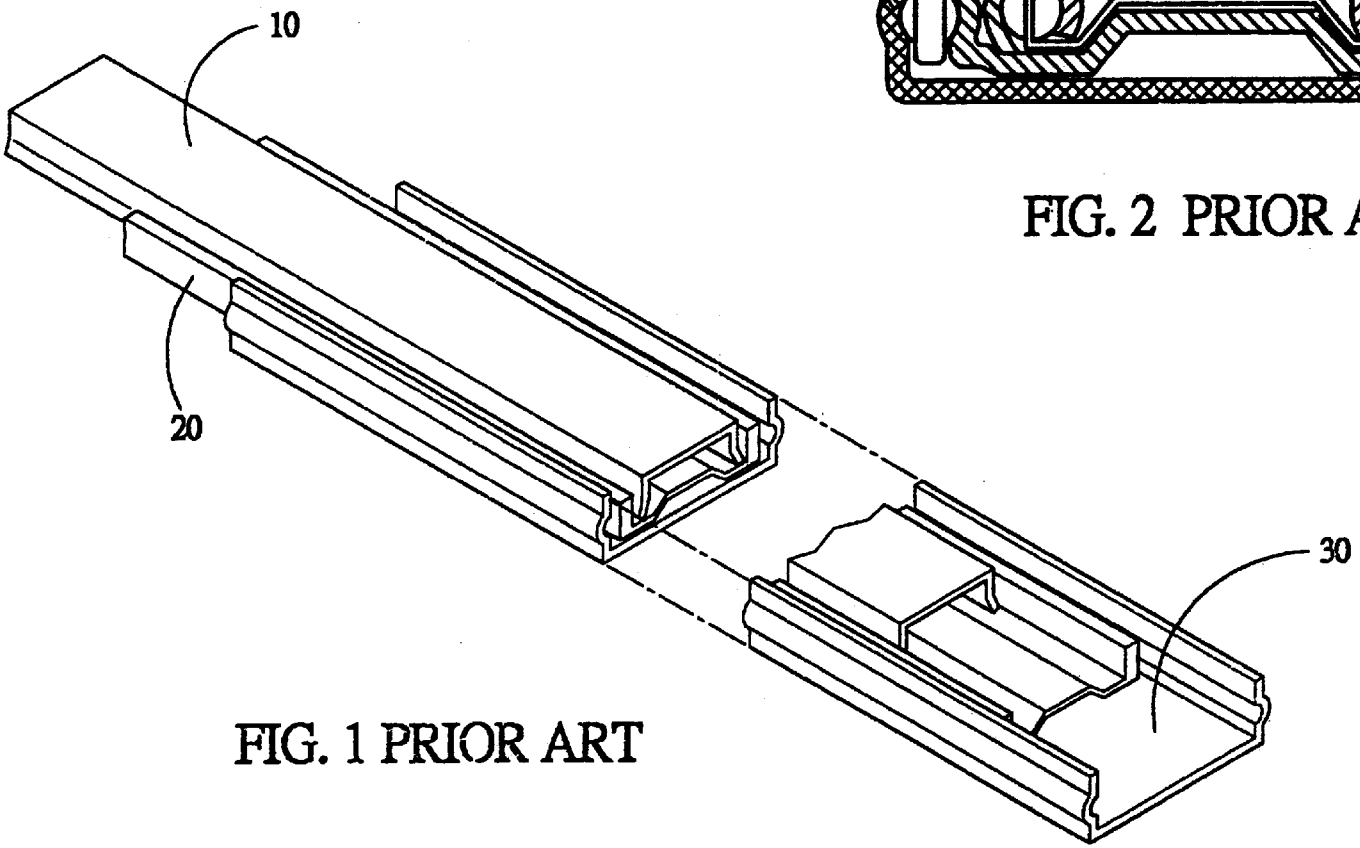
FIG. 1 PRIOR ART
FIG. 1 illustrates a sliding track assembly for use with a drawer according to the prior art.
Figure 3:
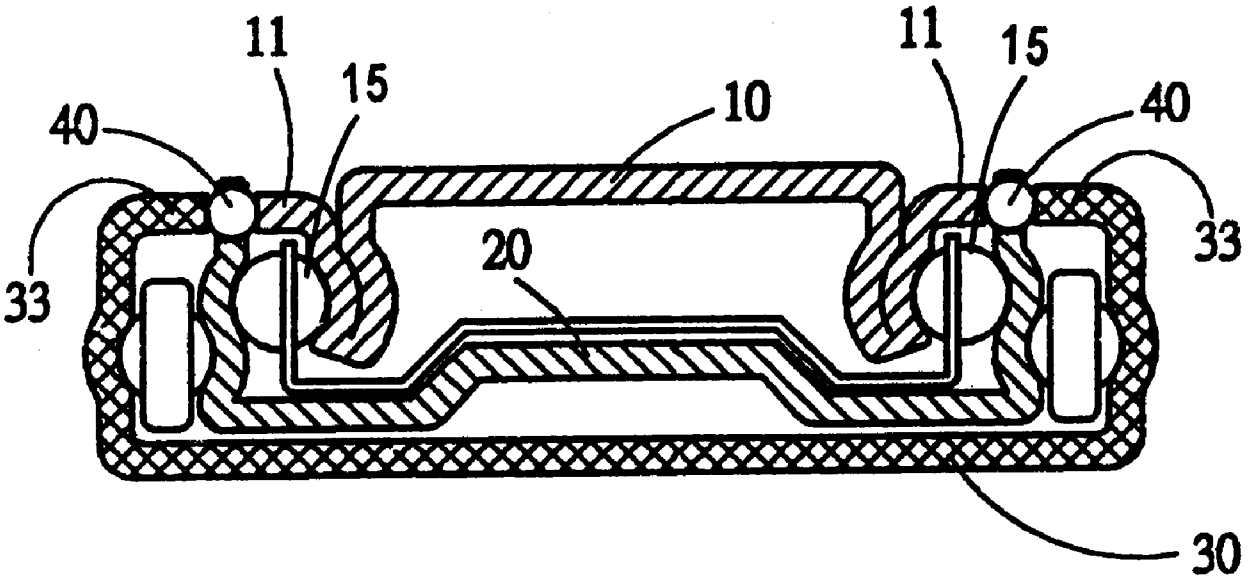
FIG. 3 is a cross sectional view of a sliding track assembly according to the present invention.

Referring to FIG. 3, a sliding track assembly is shown comprised of an outer track 30, an intermediate track 20 moved in and out of the outer track 30, an inner track 10 moved in and out of the intermediate track 20 via ball bearings 15, and a transmission mechanism 40 provided at at least one of the two opposite lateral sides of the intermediate track 20. The transmission mechanism 40 is comprised of a plurality of rolling elements, for example rolling balls or needle rollers. The outer track 30 comprises two longitudinally extended inner flanges 33 bilaterally disposed on the inside, and respectively maintained in contact with the rolling elements of the transmission mechanism 40. The inner track 10 comprises two longitudinally extended outer flanges 11 bilaterally disposed on the outside, and respectively maintained in contact with the rolling elements of the transmission mechanism 40.

Figure 4:
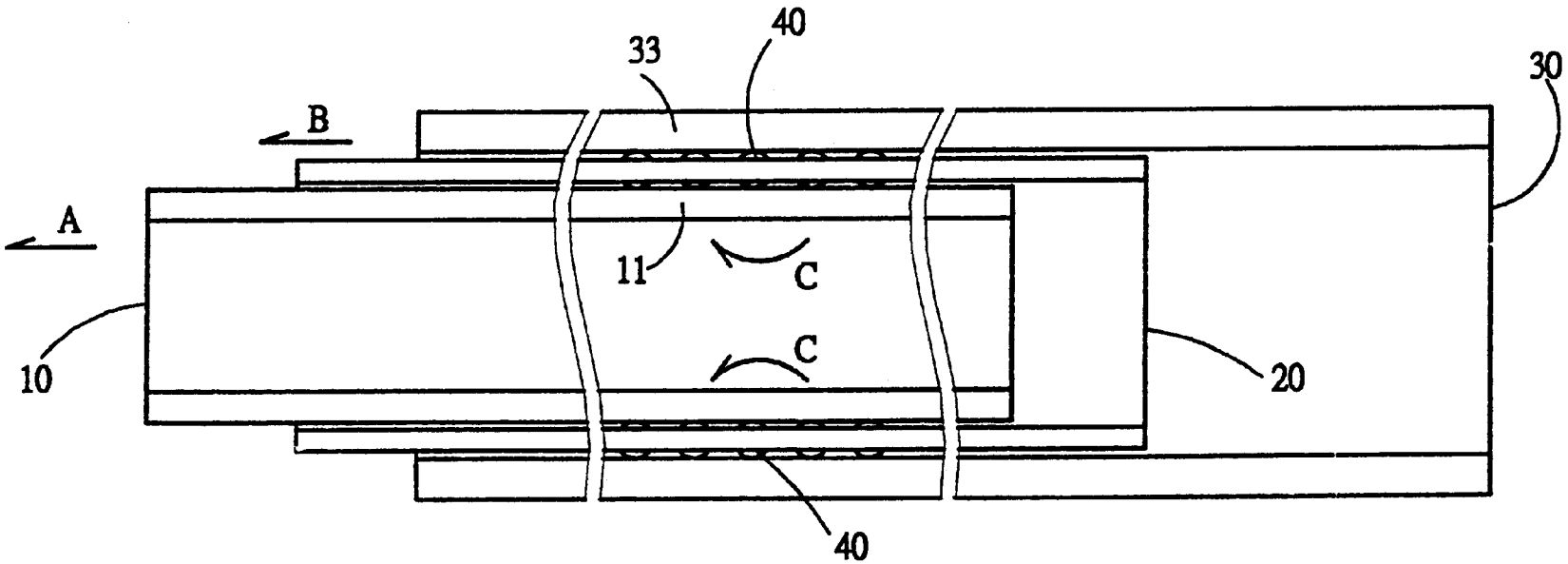
FIG. 4 is a top view of the present invention, showing the sliding track assembly operated.

Referring to FIG. 4, when the inner track 10 is moved outwards with the drawer (not shown) in direction A, the rolling elements of the transmission mechanism 40 are rotated in direction C. Because the rolling elements of the transmission mechanism 40 are also disposed in contact with the outer track 30 and the outer track 30 is not movable, the intermediate track 20 is forced by a friction force to move relative to the inner track 10 in direction B.

Figure 5:
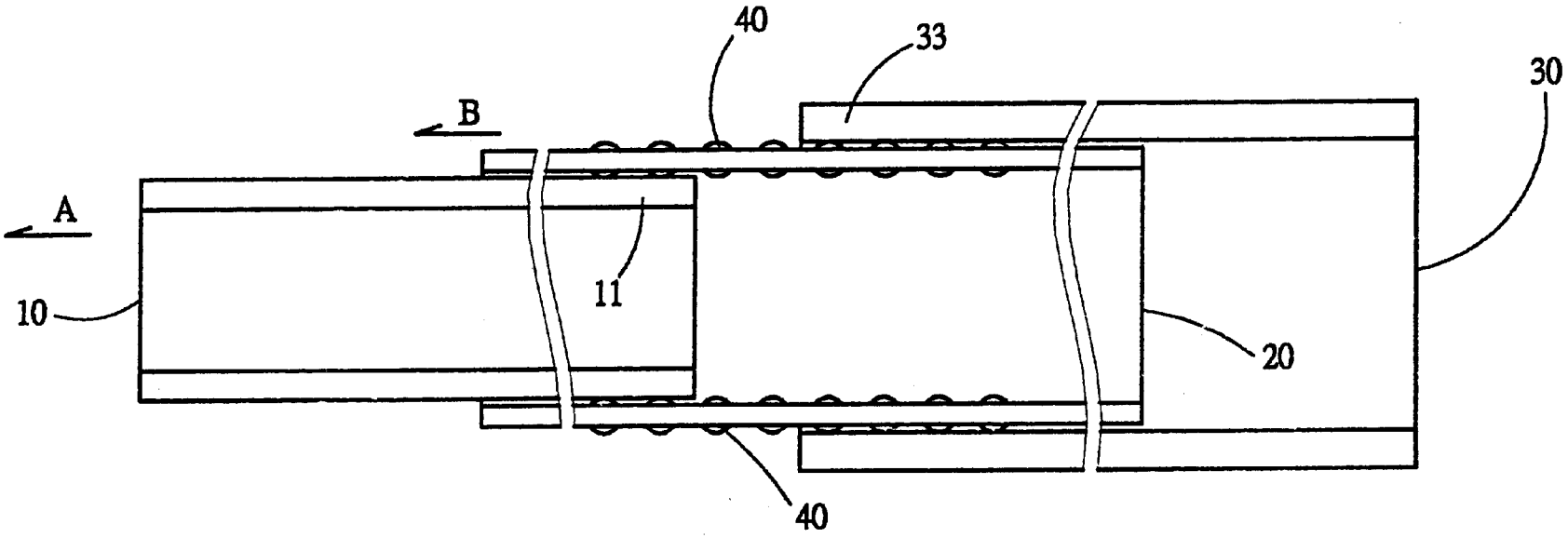
FIG. 5 shows an alternate form of the intermediate track.

FIG. 5 shows an alternate form of the present invention. According to this alternate form, the transmission mechanism 40 has a greater number of rolling elements than that shown in FIGS. 3 and 4.

As indicated above, rolling balls or needle rollers of the transmission mechanism 40 are bilaterally provided at the intermediate track 20, and disposed in contact between the inner flanges 33 at the outer track 30 and the outer flanges 11 at the inner track 10 to guide relative movement between the inner track 10 and intermediate track 20, as well as the relative movement between the intermediate track 20 and the outer track 30.

It is to be understood that the drawings are designed for purposes of illustration only, and are not intended for use as a definition of the limits and scope of the invention disclosed.

What the invention claimed is:

1. A sliding track assembly comprising an outer track, a channel shaped intermediate track movable in and out of said outer track, an inner track movable in and out of said intermediate track by ball bearings, said ball bearings contacting only said inner and intermediate tracks, and a transmission mechanism provided at two opposite lateral sides of said intermediate track, wherein said outer track comprises two longitudinally extending inner flanges; said inner track comprises two longitudinally extending outer flanges; and said transmission mechanism is comprised of a plurality of rolling elements respectively disposed in contact between the inner flanges at said outer track, the outer flanges at said inner track, and the lateral sides of said intermediate track.

* * * * *